United States Patent [19]

Barrois

[11] Patent Number: 4,541,339

[45] Date of Patent: Sep. 17, 1985

[54] INKING UNIT

[75] Inventor: Claus D. Barrois, Wurzburg, Fed. Rep. of Germany

[73] Assignee: Koenig & Bauer Aktiengesellschaft, Wurzbug, Fed. Rep. of Germany

[21] Appl. No.: 712,500

[22] Filed: Mar. 18, 1985

Related U.S. Application Data

[62] Division of Ser. No. 366,263, Apr. 7, 1982, Pat. No. 4,519,312.

[30] Foreign Application Priority Data

Jul. 15, 1981 [DE] Fed. Rep. of Germany ..... 3127880

[51] Int. Cl.[4] ..... B41F 31/26; B41F 31/10

[52] U.S. Cl. ..... 101/349; 101/148; 29/122

[58] Field of Search ..... 101/348–351, 101/148, DIG. 7, DIG. 8; 29/122

[56] References Cited

U.S. PATENT DOCUMENTS

| | | | |
|---|---|---|---|
| 1,077,882 | 11/1913 | Holz | 101/DIG. 8 |
| 1,490,539 | 4/1924 | Pucci | 29/122 |
| 1,715,741 | 6/1929 | Claybourn | 101/DIG. 8 |
| 1,840,009 | 1/1932 | Ball et al. | 101/350 |
| 2,514,321 | 7/1950 | Fekete | 29/122 |
| 3,433,155 | 3/1969 | Norton | 101/148 |
| 3,687,073 | 8/1972 | Harrison | 101/350 |
| 3,803,793 | 9/1975 | Schubert | 101/351 |
| 4,454,813 | 6/1984 | Barrois et al. | 101/349 |

FOREIGN PATENT DOCUMENTS

| | | | |
|---|---|---|---|
| 193459 | 9/1951 | Australia | 101/DIG. 7 |

*Primary Examiner*—William Pieprz

*Attorney, Agent, or Firm*—Jones, Tullar & Cooper

[57] ABSTRACT

A liquid transport mechanism for use particularly in transporting and evenly distributing printing ink in a rotary printing machine is disclosed. A plurality of generally cone shaped ink transport rollers are placed about the periphery of one or more ink relief equalizing cylinders. The axes of rotation of the rollers are angled with respect to the axes of rotation of the ink relief equalizing cylinders. The covered surfaces of the rollers, which are disposed generally in pairs, contact the surface of the ink cylinders to form ink bridges which split the ink coating on the cylinders and cross transport it longitudinally along the length of each of the ink relief equalizing cylinders. The ink metering unit in accordance with the present invention uniformly and rapidly equalizes ink thickness without the need for ink zone adjusting screws and doctor blades.

2 Claims, 10 Drawing Figures

INKING UNIT

CROSS-REFERENCE TO RELATED APPLICATIONS

This application is a division of application Ser. No. 366,263, filed Apr. 7, 1982 now U.S. Pat. No. 4,519,312, 5/28/85.

FIELD OF THE INVENTION

The present invention is directed generally to an apparatus for use in transporting a liquid medium. More particularly, the present invention is directed to an ink transport unit for use in a printing press. Most specifically, the present invention is directed to an apparatus to transport and evenly distribute printing ink longitudinally along the surface of a cylinder in a printing unit. A plurality of generally cone shaped ink transport rollers are positioned so that their axes intersect the longitudinal axis of the ink relief equalization cylinder upon whose surface the ink is to be distributed. This angle of intersection is generally about 45° and pairs of the rollers cooperate to form an ink bridge which splits the ink off the cylinder's surface and moves the ink longitudinally along the length of the cylinder. A plurality of these pairs of ink distributing rollers may be placed along the length of the ink relief equalizing cylinder with the cylinder also being capable of transverse motion. The ink which is applied to the cylinder from the inking unit is quickly and efficiently spread evenly on the surface of the ink equalizing cylinders by the ink transport rollers of the present invention.

DESCRIPTION OF THE PRIOR ART

Various mechanisms which are used to transport a liquid medium such as printing ink longitudinally along the surface of a covering on a cylinder in a printing unit are known generally in the art. These mechanisms typically take the form of inking unit cylinders which are supported in a manner such that they can move in the direction of their longitudinal axis of rotation. However, the amount of longitudinal motion which each such cylinder can undergo is limited so that it is necessary to provide a plurality of these inking cylinders which cooperate with each other when it is necessary to cross transport the ink over a relatively long length.

A so-called short inking unit is disclosed in German Pat. No. 2,323,025. This apparatus provides a device which permits equalizing a relief of a residual ink thickness layer so that the detrimental stencilling effect is avoided. This unit does not require any ink zone adjusting screws. It does, however, utilize a doctor blade. Such blades are known in the art and are subject to wear and often present adjustment problems. Furthermore, these doctor blades do not wear uniformly along their length so that the ink thickness on the cylinder is apt not to be even.

In these prior art ink metering units, the rotation of the inking cylinder and the metering cylinder are in the same direction but at differing peripheral speeds. There is accordingly, a potential for damaging both of the cylinders if the inking unit is allowed to run dry. Thus the prior art ink metering units do not readily accomodate lengthy cross transports of inks, have often required doctor blades which wear and do not provide uniform ink metering, and are apt to be damaged if the inking unit is allowed to operate without ink.

SUMMARY OF THE INVENTION

It is an object of the present invention to provide a liquid transport apparatus.

Another object of the present invention is to provide a mechanism which transports a liquid along a rotating cylinder in the direction of the longitudinal axis of the cylinder A further object of the present invention is to provide a liquid transport medium for use with a cylinder wherein the cylinder need not move longitudinally along its axis of rotation.

Yet another object of the present invention is to provide an ink metering unit for a printing press.

Still a further object of the present invention is to provide an ink metering unit having pairs of ink bridge forming transport rollers.

A yet further object of the present invention is to provide an ink metering unit in which the ink transport rollers are frictionally driven.

As will be set forth in greater detail in the description of the preferred embodiments, one or more ink relief equalizing cylinders are placed about the periphery of an inking cylinder. These ink relief equalizing cylinders are each provided with a plurality of pairs of generally cone shaped ink transport rollers whose function is to equalize the ink thickness along the surface of each ink equalizing cylinder. In this way, the ink thickness across the width of the ink cylinder is kept uniform. The generally cone shaped ink transport rollers are driven by frictional engagement with the ink relief equalizing cylinders and do not require complex drive or adjustment systems.

The ink transport rollers are spaced in cooperating pairs along the length of each of the ink equalizing cylinders and distribute the ink along the entire surface of each ink equalizing cylinder. It is not necessary that each ink equalizing cylinder be mounted for motion along its longitudinal axis of rotation. However, the ink transport rollers can also be used with an ink equalizing cylinder which is supported so that it is capable of longitudinal motion along its axis of rotation.

The generally cone shaped ink rollers contact the surface of the ink equalizing cylinders and function to rapidly transfer ink along the surface of each cylinder in a manner which results in an equal ink thickness over the length of the inking cylinder without the use of the previously required doctor blades. As was discussed previously, these doctor blades are subject to wear and deterioration so that they often do not provide uniform ink metering.

An extremely thick ink layer thickness relief can be modified by the ink metering means of the present invention over the length of an inking cylinder in such a way that the degree of inequality becomes so small that it has no consequence on the printed product. It is possible to produce an ink layer of a pre-selected thickness on an inking cylinder, this ink layer being substantially of even thickness over the whole roller length. Since the ink thickness over the entire cylinder can be made uniform by the ink rollers in accordance with the present invention, it is possible to eliminate the adjusting mechanisms which have previously been required. These previous adjusting mechanisms regulated the ink thickness in ink zone widths, a practice which although quite common, is also very expensive and does not provide satisfactory results.

The ink metering unit in accordance with the present invention allows the equalization of the ink thickness relief over the entire length of the ink equalization cylinder in a minimum amount of time. Such ink equalization can be accomplished even if the difference between the minimum and maximum ink thicknesses along the length of the ink cylinder is so great that it could not have been equalized by longitudinal motion of the ink equalizing cylinders as was conventionally done in prior art devices. It is therefore, possible to print extreme formes without noticing any stencilling effect on the printed product.

The ink metering rollers in accordance with the present invention do not require any special drive means. They are mounted to frictionally engage the surface of the ink equalizing cylinder which is itself driven by any conventional means. Rotation of the ink cylinder imparts rotation to the ink metering rollers which function to transport the ink along the length of the ink cylinder.

The ink metering units in accordance with the present invention are particularly useful in wet offset printing and facilitate the evaporation of the damping fluid which may remain after printing so that the ink film which returns to the inking unit is as free of damping fluid as possible. The ink is also kept elastic due to the number of ink splitting points provided by the numerous contact points between the ink rollers and the ink relief equalization cylinder.

The ink metering unit in accordance with the present invention uses a plurality of pairs of ink transport rollers which are frictionally driven by the ink equalization cylinders to uniformly and equally distribute the ink about the entire surface of the ink equalization cylinder without requiring longitudinal movement of the cylinder, without the use of doctor blades, and without causing undue wear on the ink equalizing cylinders.

BRIEF DESCRIPTION OF THE DRAWINGS

While the novel features of the ink metering unit in accordance with the present invention are set forth with particularity in the appended claims, a full and complete understanding of the invention may be had by referring to the detailed description of the preferred embodiments as set forth hereinafter and as may be seen in the accompany drawings in which:

DESCRIPTION OF THE PREFERRED EMBODIMENTS

Figure 1:
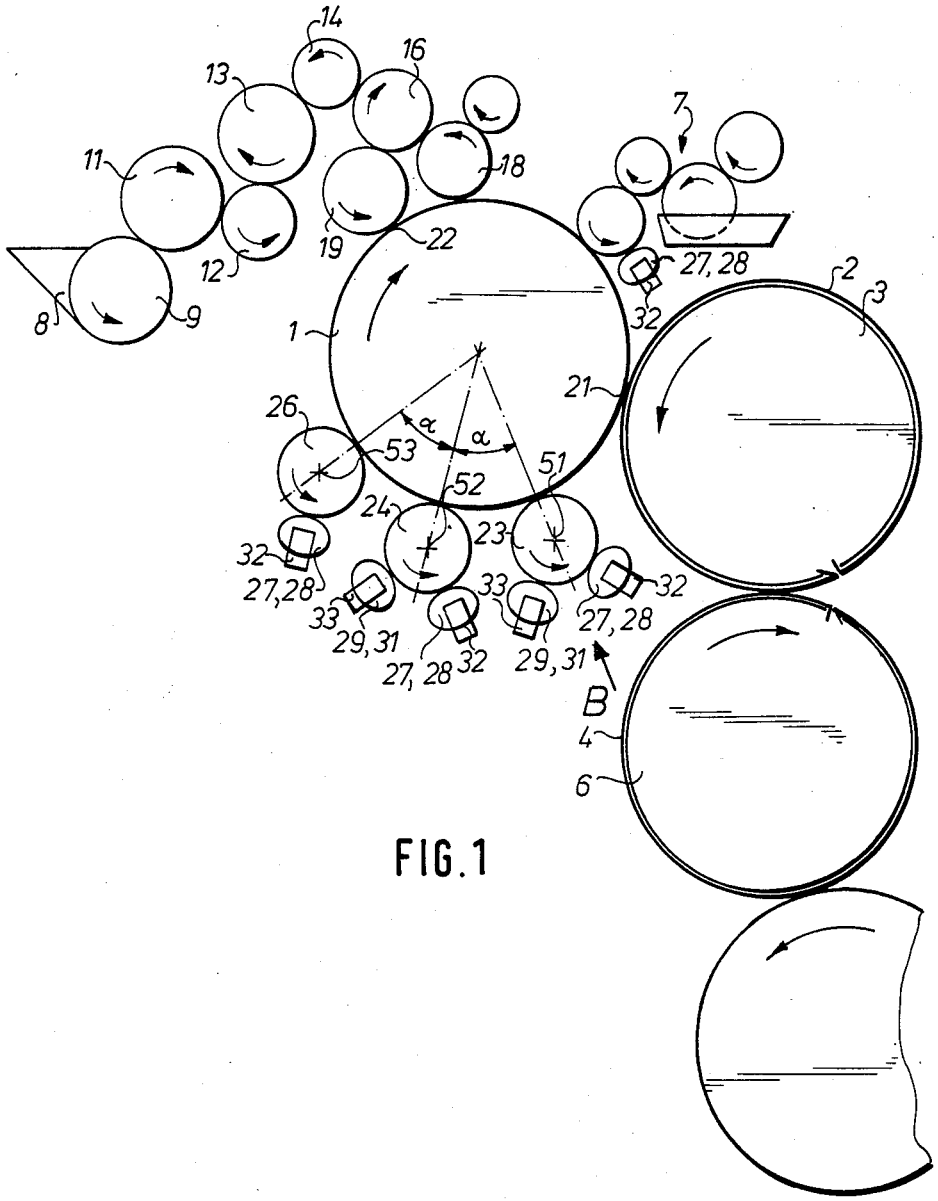
FIG. 1 is a schematic side elevation view of an inking unit in accordance with the present invention with the side frames removed for clarity.

Referring initially to FIG. 1, there may be seen a schematic representation of a rotary printing machine including the ink metering unit in accordance with the present invention. The printing machine shown in FIG. 1, is intended for use in a wet offset printing process and will be described as such. It will however, be understood that the ink metering unit is not to be limited to such a usage. In its broader concept, the invention is directed to a liquid transport mechanism which could be applied to the even distribution of any fluid such as damping fluid in a wet offset printing process or even more generally, to the transport and distribution of any liquid.

In the rotary printing machine shown in FIG. 1, an inking unit applies ink to a rubber covered inking cylinder 1 which then inks a printing plate 2 which, in the preferred embodiment, is a wet offset plate. An inked image formed by printing plate 2 is then transferred onto a blanket 4 of a blanket cylinder 6. Inking cylinder 1, forme cylinder 3 and blanket cylinder 6 preferably have equal diameters and are driven by any conventional means at equal speeds. The inking cylinder 1 or the printing plate 2 is dampened by a damping unit 7.

Inking cylinder 1 receives its printing ink from an ink duct 8 which does not need to have any ink zone adjusting screws. In order to provide a relatively even ink film, a vibrator inking unit or the film inking unit shown in FIG. 1 can be used. Such ink filming units are generally known in the art as may be seen, for example, in German Pat. No. 901,057 and accordingly, no detailed description thereof is believed necessary.

In the preferred embodiment, the printing ink being supplied by the ink duct 8, contacts a duct roller 9, whose rotational speed can be controlled, and is then directed over intermediate cylinders 11, 12, 13, 14, 16 onto a first transfer cylinder 18 and onto a second transfer cylinder 19. Both transfer cylinders 18 and 19 are in contact with the inking cylinder 1. The duct roller 9, the intermediate cylinders 11 to 16, and the transfer cylinders 18 and 19 have a smaller diameter than that of the inking cylinder 1, and the cylinders 11 to 16, 18, and 19 have the same peripheral speed as the inking cylinder 1. The cylinders 14, 18, 19 are constructed as position-changing ink distributing cylinders; i.e. as cylinders which can be moved longitudinally along their axes of rotation.

A plurality of rotating ink relief equalizing cylinders 23, 24, and 26 which are supported by any conventional means so that they can move longitudinally along their axes of rotation for a distance of, for example, 35 mm, are spaced about the periphery of the inking cylinder 1, preferably between a first contact point 21 where the inking cylinder 1 contacts the forme cylinder 3 and a second contact point 22 where the inking cylinder 1 contacts the second ink transfer cylinder 19. In the preferred embodiment, the three inking equalizing cylinders 23, 24, 26 are spaced from each other at an angle $\alpha$ of, for example 30°. These ink relief equalizing cylinders 23, 24, and 26 may have the same diameter as the transfer cylinders 18 and 19. They are provided with a hard oleophilic covering which accepts printing inks with the covering being, for example, a ceramic or copper. The ink relief equalizing cylinders 23, 24, and 26 rotate under pressure against the periphery of inking cylinder 1.

One or more series, for example, two series 32 and 33 of rotatable ink transport or bridging rollers 27, 28, 29, and 31 which will be referred to hereinafter as rollers are mounted for cooperation with each of the ink relief equalizing cylinders 23, 24, and 26, as may be seen generally in FIG. 1 and more specifically in FIG. 2. Either series 32 or 33 of rollers 27 and 28 or 29 and 31, respectively comprise a plurality of pairs of rollers 27 and 28 or 29 and 31 such as, for example, 20 such pairs which extend along the length of the ink relief equalizing cylinders 23, 24, and 26. It will be understood that the specific number of such pairs of rollers will depend on the print width.

Figure 2:
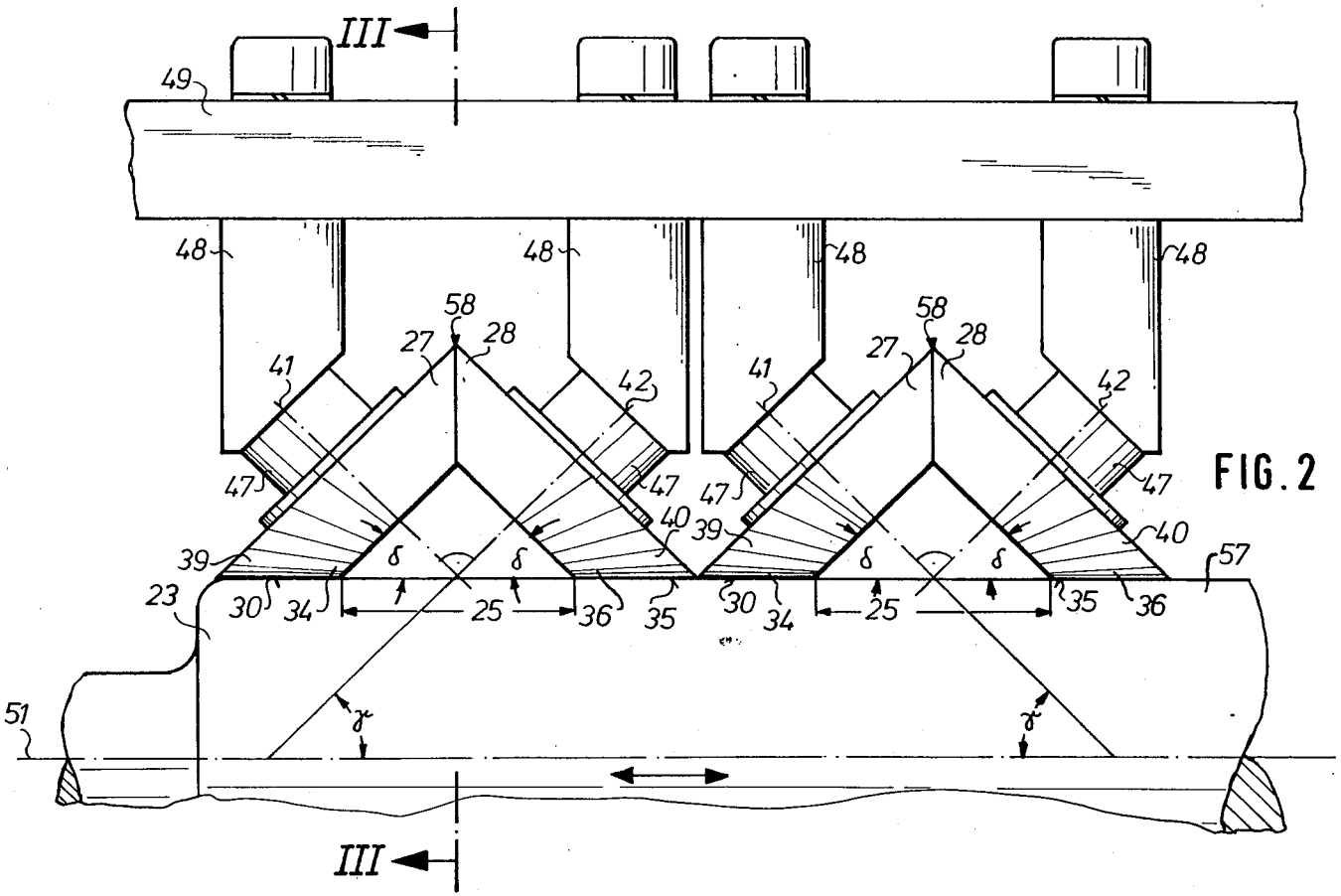
FIG. 2 is a schematic view of an ink equalizing cylinder with a first preferred embodiment of the ink transport rollers in accordance with the present invention.
Figure 3:
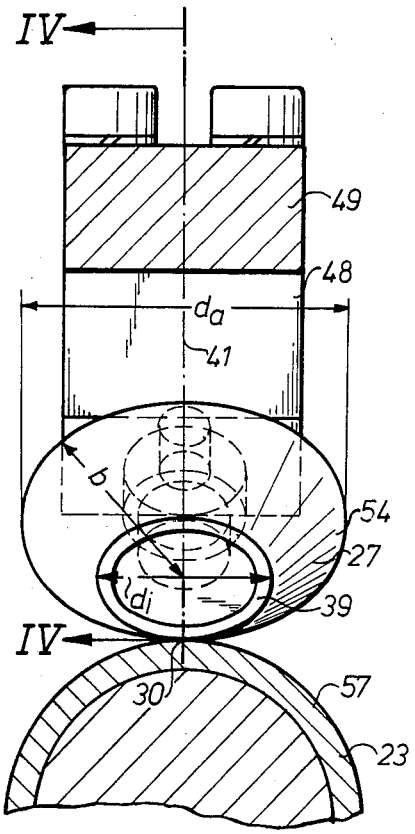
FIG. 3 is a sectional view of the assembly of FIG. 2 taken along line III—III of FIG. 2.
Figure 8:
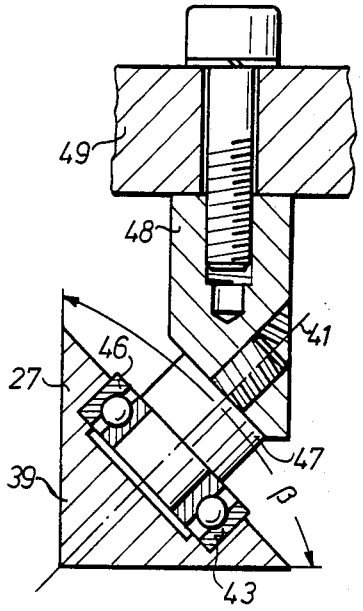
FIG. 8 is a sectional side view of a varient of the ink roller of FIG. 4 in accordance with the present invention.
Figure 4:
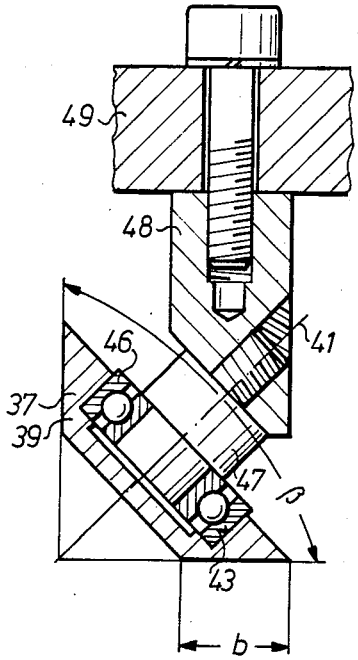
FIG. 4 is a sectional view of the ink transport roller portion of FIG. 3, taken along line IV—IV of FIG. 3.

Each of the rollers 27, 28, 29, or 31 are preferably in the shape of a straight truncated cone, as may be seen most clearly in FIGS. 2, 3, and 4. Alternatively, as may be seen in FIG. 8, rollers 27 and 28 may be in the form of complete cones; i.e. cones which are not truncated. Each such roller has, in the preferred embodiment, an outer diameter "$d_a$" of 55 mm, an inner diameter "$d_i$" of 25 mm, and a width "b" of covering 39 or 40 of approximately 20 mm. They consist, or at least their coverings consist of an oleophilic material, for example, rubber. Every roller 27, 28, 29, 31, is provided with a cylindrical recess 43 that is concentric with a longitudinal cone axis 41, 42 and into which a ball bearing assembly 46 is pressed, whose inner ring is pressed into a journal 47. Every journal 47 is rigidly attached to a short support 48, which, in turn, is screwed onto bar 49. Every bar 49 is supported at its extremities by the side frames of the inking unit (not shown) and is aligned in such a way that its longitudinal axis extends parallel to an axis of rotation 51, 52, or 53 of the ink relief equalizing roller 23, 24, or 26 coordinated to it.

Rollers 27, 28, 29, and 31 preferably have an opening angle $\beta$ of 90°, and their axes of rotation 41 or 42 intersect the axes of rotation 51, 52, or 53 of the ink relief equalizing cylinder 23, 24, or 26 coordinated to them at an inclination angle $\gamma$ of 45°. Every roller 27, 28, 29, 31 has its preferably smooth covering surface 34, 36, 54, or 56 in frictional contact with a covering surface 57 of the relief equalizing cylinder 23, 24, or 26 at a setting angle $\delta$ of 45°, so that the ink carrying relief equalizing rollers 23, 24, and 26 drive the rollers 27, 28, 29, 31 which contact them, so that these rollers rotate around their axes of rotation 41 or 42.

Figure 6:
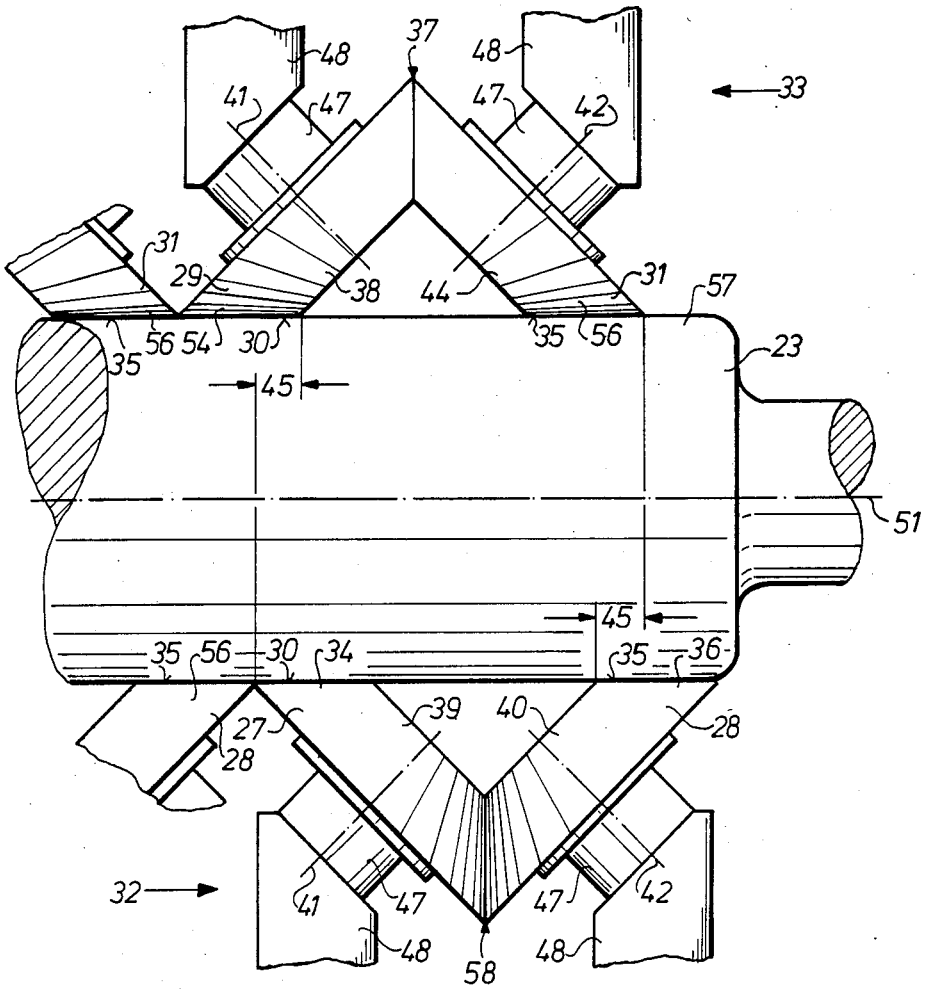
FIG. 6 is a schematic side view of a portion of an ink equalizing cylinder and ink transport rollers taken in the direction indicated by arrow B in FIG. 1 and showing the ink roller pairs in a staggered array.

As can be seen most clearly in FIGS. 2 and 6, each of the roller pairs 27, 28 and 29, 31 have several contact lines with each other and with the surface of each ink relief equalizing cylinder. Coverings 34 and 36 of rollers 27 and 28 contact covering 57 of cylinder 23 at contact lines 30 and 35 and contact each other at contact line or surface 58. Similarly, as may be seen in FIG. 6, coverings 54 and 56 of rollers 29 and 31 contact covering 57 of cylinder 23 at contact lines 38 and 44 and contact each other at contact line or surfaces 37. Each of these contact lines or surfaces is an ink splitting point where the ink thickness on one of the surfaces is divided between the two contacting rollers or between the contacting roller and the ink relief equalizing cylinder.

Due to the arrangement of the rollers set in pairs against each other, preferably over the whole length of each cylinder 23, 24, 26, the rollers pairs 27–28; 29–31 form on the covering surface 57 of their respective ink carrying cylinder, for example on relief equalizing cylinder 23, a printing ink bridge in the longitudinal direction of the cylinder; i.e. at right angles to the ink flow direction. When the roller pairs 27–28; 29–31 rotate on the rotating and ink carrying cylinder 23, a printing ink shunting effect is created. That means, for example in the case of printing ink excess at the contact point 30 between the roller 27 and the relief equalizing cylinder 23, that the covering surface 34 of the roller 27 takes printing ink off the covering surface 57 of the relief equalizing cylinder 23 when the cylinder and rollers rotate, in accordance with the concept of ink splitting. The printing ink moves from the covering surface 34 of roller 27 over the ink splitting point or contact point 58 between the pair of rollers 27–28, onto the covering surface 40 of the roller 28, and from there over the ink splitting point or contact point 35 onto the covering surface 57 of the relief equalizing cylinder 23. In the case of printing ink excess at the contact point 35, the printing ink flow would be reversed with the ink always flowing from the higher ink level in the direction of the lower ink level on the printing ink carrying cylinder. A distance 25 between an ink take-off point, for example contact point 30, and an ink delivery point, for example, contact point 35, can be pre-selected on the cylinder 23 by selection of the diameter of the roller 27, 28, 29, or 31.

Since the pairs of rollers 27–28; 29–31 are disposed, as mentioned above, in such a way that they form a sort of bridge, the printing ink is capable of being transported along the longitudinal cylinder axis from a first location on the relief equalizing cylinder 23, 24, or 26 to a second location without any changing motion of the relief equalizing cylinders 23, 24, or 26. Nevertheless, ink relief equalization over the length of the cylinders will be substantially accelerated by providing changing longitudinal motion of the relief equalizing cylinders 23, 24, and 26.

Figure 5:
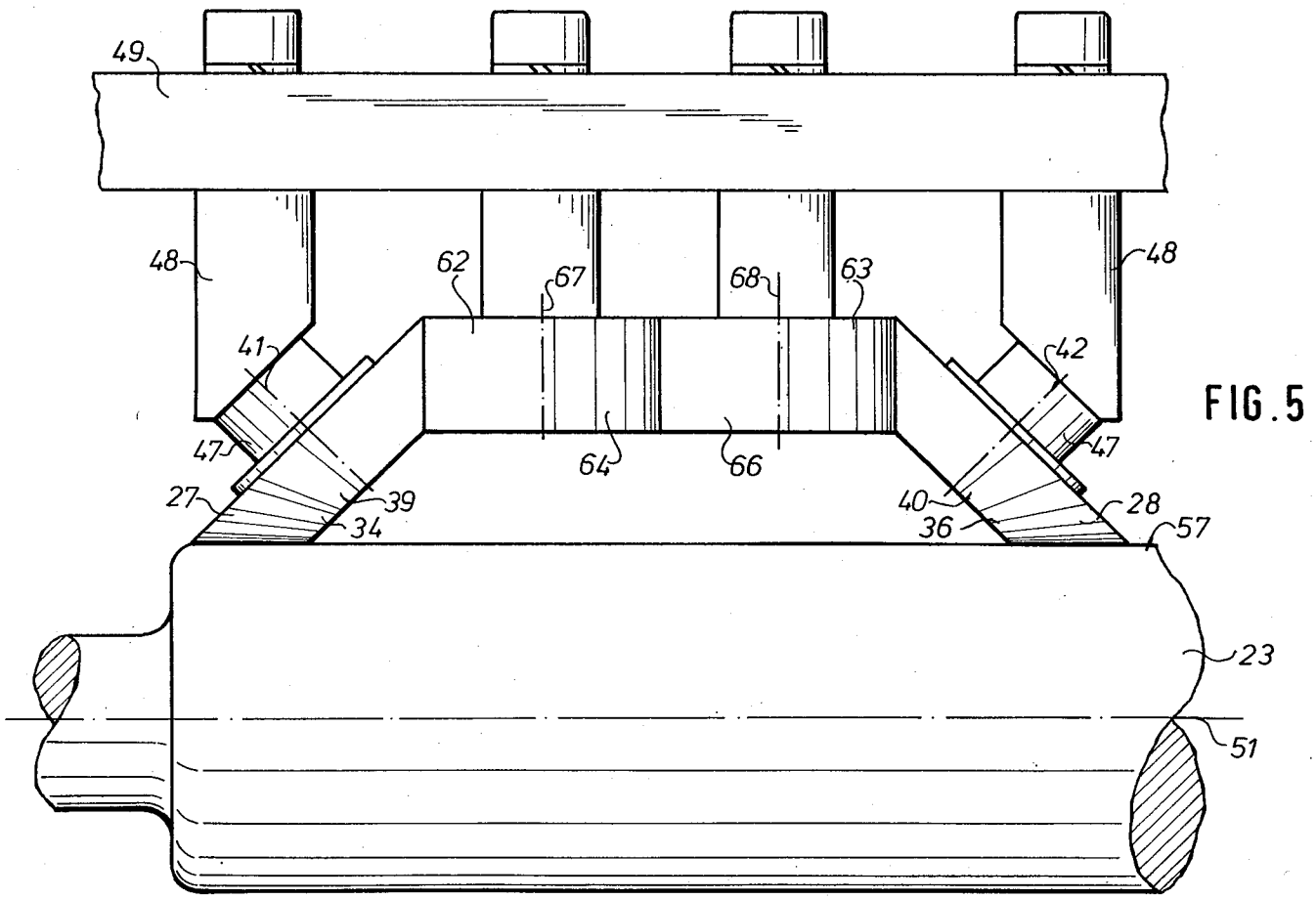
FIG. 5 is a schematic view of an ink equalizing cylinder with a second preferred embodiment of the ink transport rollers in accordance with the present invention.

In the second preferred embodiment shown in FIG. 5, cylindrical intermediate rollers 62 and 63 having a covering of an oleophilic material such as rubber, are located in a horizontal position, and are interpositioned between the rollers 27 and 28. Rollers 62 and 63 are secured to bar 49, are capable of rotating about their axes of rotation 67, 68, and their covering surfaces 64, 66 are pressed against each other in such a way that both intermediate rollers 62 and 63 rotate in frictional contact with each other. The covering surface 34 of the first inclined roller 27 is in frictional contact with the covering surface 64 of the first intermediate roller 62, and the covering surface 36 of the second inclined roller 28 is in frictional contact with the covering surface 66 of the second intermediate roller 63. The rollers 27 and 28, are secured to bar 49 as previously discussed.

In FIG. 6, printing ink carrying relief equalizing cylinder 23 is shown as a cylinder on which two series 32, 33 of rollers 27–28; 29–31 are disposed. Both series 32, 33 are staggered with respect to each other in the longitudinal cylinder direction in such a way that an overlap 45 of, for example 10 mm between the roller pairs 27–29 and 28–31, which are spaced from each other about the cylinder periphery direction, is provided. As may be seen in FIG. 1, two similar series of rollers 27–28; 29–31 are disposed about the second relief equalizing cylinder 24. These series are staggered with respect to each other in an overlapping fashion, as described above, and are also staggered with respect to the rollers of the series 32, 33 on relief equalizing cylinder 23. The series 32 of rollers 27, 28 of the relief equalizing cylinder 26 are similarly staggered to the series 32, 33 of rollers on the relief equalizing cylinder 24.

Figure 7:
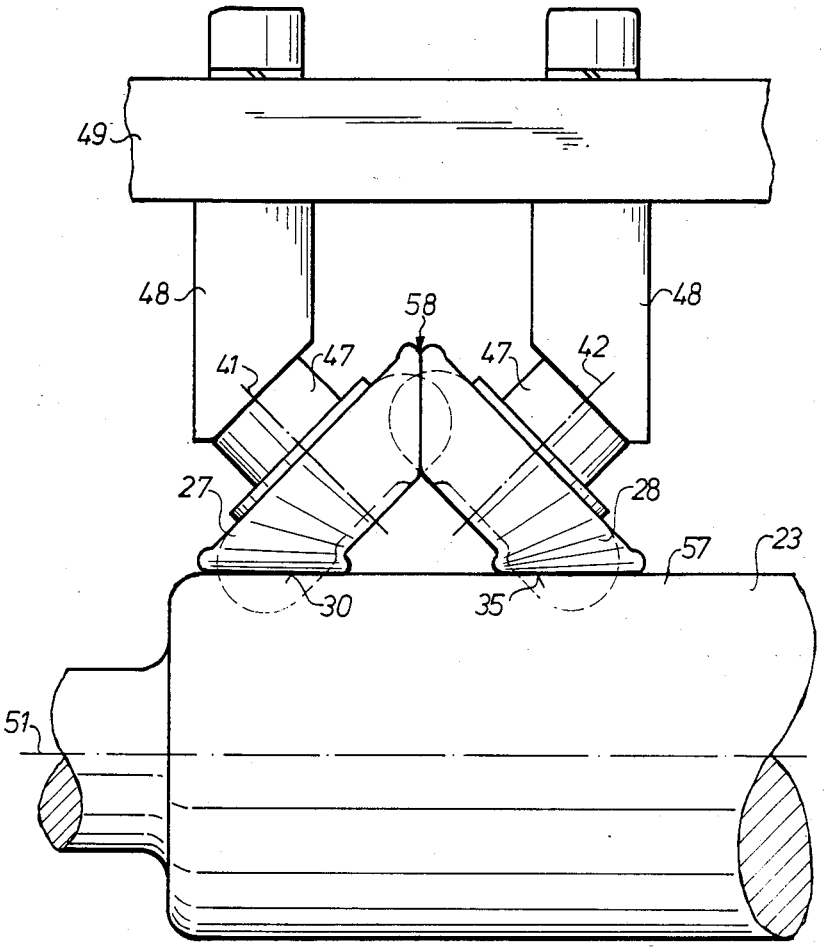
FIG. 7 is a schematic view of an ink equalizing cylinder with a third preferred embodiment of the ink transport rollers in accordance with the present invention.

In the third preferred embodiment shown in FIG. 7, the roller 27, 28 are not cone shaped but are generally toroidal in their undeformed states, as seen in dashed lines in FIG. 7. These rollers 27, 28 have covering surfaces 39, 40 which, in their undeformed states are semicircular in cross section. These toroidal rollers 27, 28 are formed of a material such as soft rubber. Ink splitting points 58, 30, and 35 are formed when these soft rubber rollers are pressed against each other and are pressed onto the relief equalizing cylinder 23. The setting angle $\delta$ of 45° need not be observed for rollers made of soft material.

Figure 9:
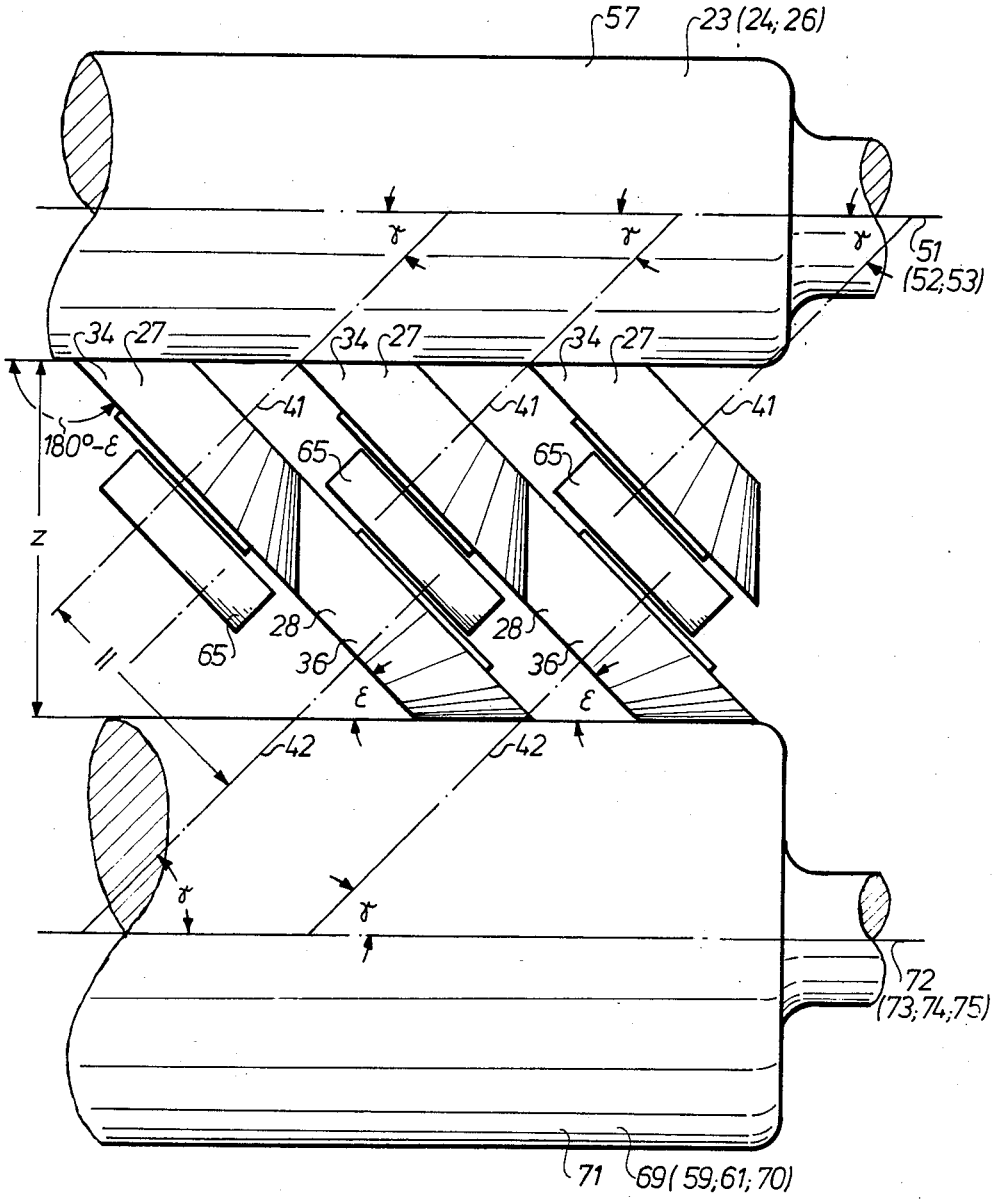
FIG. 9 is a schematic view of an ink equalizing cylinder with a fourth preferred embodiment of the ink transport rollers in accordance with the present invention.
Figure 10:
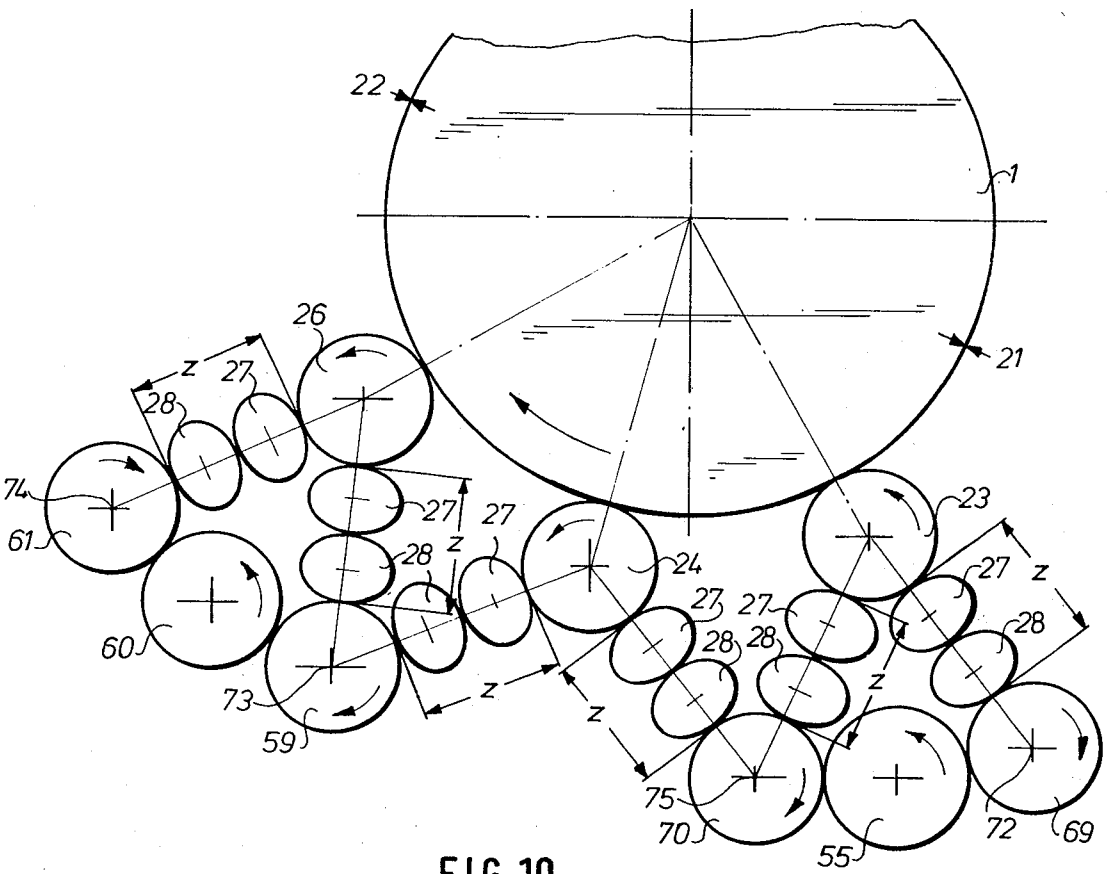
FIG. 10 is a schematic side elevation view of the ink equalizing cylinders and ink rollers of FIG. 9 in contact with the inking cylinder of the printing unit.

A fourth preferred embodiment of an inking unit in accordance with the present invention may be seen by referring to FIGS. 9 and 10. As may be seen most clearly in FIG. 10, the three ink relief equalizing cylinders 23, 24, and 26 are positioned about the periphery of inking cylinder 1 between contact points 21 and 22, as was discussed previously with respect to FIG. 1. In the embodiment shown in FIGS. 9 and 10, however, additional ink relief equalizing cylinders 69 and 70 which cooperate with equalizing cylinders 23 and 24 and ink relief equalizing cylinders 59 and 61 which cooperate with equalizing cylinders 24 and 26 are provided. The additional ink relief equalizing cylinders 69, 70 and 59, 61 are rotatably supported in the printing unit side frames. They are driven by the main drive means of the printing machine and are supported in a manner such that they can move along their longitudinal axes of rotation.

An intermediate cylinder 55 is rotatably supported between ink relief equalizing cylinders 69 and 70 with its covering surface being in contact with the covering surfaces of equalizing rollers 69 and 70. A similar intermediate roller 60 is placed between equalizing rollers 59 and 61. The coverings of the rollers 55, 59, 60, 61, 69, and 70 are all oleophilic materials.

As may be seen most clearly in FIG. 9, a plurality of roller pairs 27–28 are supported on support bars 65 in the space "z" between the relief equalizing cylinders 23–69; 24–70; 24–59; 59–26, and 26–61. Support bars 65 are secured to suitable transverse support members (not shown) which are, in turn, secured to the side frames of the printing unit. Each roller pair 27 and 28 is formed by two truncated cone shaped rollers of the type previously described which rollers have a cone opening angle $\beta$ of 90°. The axes of rotation 41 and 42 of rollers 27 and 28 do not intersect each other as they do in the previously described embodiments at an angle of 90°, but extend parallel to each other, and their covering surfaces 34 and 36 contact each other. This provides a stretched and oblique arrangement of the roller pairs 27–28 between the cylinders 23–69; 23–70; 24–70; 24–59; 26–59, or 26–61, with the covering surfaces 34 of the first rollers 27 rotating on the covering surface 57 of the first cylinder 23; 24; 26 in frictional contact with this covering surface 57, and the covering surfaces 36 of the second rollers 28 rotating in frictional contact with the covering surface 71 of the second cylinder 69; 70; 59; 61. The axes of rotation 41, 42 of the rollers 27; 28 are inclined at an angle of preferably 45° to the axes of rotation 51; 52; 53; 72; 73; 74; 75 of the cylinders 23; 24; 26 or 69; 59; 61; 70.

As in the previously described embodiments, ink is transported and distributed along the surfaces of the ink relief equalizing rollers 23, 24, and 26 by the cooperation of the various roller pairs 27 and 28. In this fourth embodiment, however, the ink is also transported along the surfaces of the additional ink relief equalizing rollers 59, 61, and 69, 70.

In all of the above disclosed embodiments of the ink metering mechanism in accordance with the present invention, transport of the ink and its equalization on the surface of the inking cylinder 1 is accomplished by the cooperation of the roller pairs with their corresponding ink relief equalizing cylinders. The ink is cross transported along the length of the ink relief equalizing cylinder with the ink being split between the roller coverings and the cylinder coverings until the ink layer has attained a uniform thickness which is imparted to the inking cylinder 1. The various ink transport rollers do not require any drive means and are simple in operation and maintenance. Their sizes can be varied and the number of pairs can also be varied along the length of the ink relief equalizing cylinders to accomodate for various printing widths. The ink metering system described hereinabove does away with the need for expensive ink zone adjusting screws, doctor blades and the various other ink thickness adjusting means which have been previously required.

While preferred embodiments of an ink metering assembly in accordance with the present invention have been fully and completely set forth hereinabove, it will be obvious to one of skill in the art that a number of changes in, for example, the support means for the ink transport rollers, the specific bearing means, the coverings for the rollers and cylinders, the number of roller pairs, and the like could be made without departing from the true spirit and scope of the invention and that the invention is to be limited only by the following claims.

I claim:

1. A liquid transport mechanism for distributing a liquid medium evenly on the surfaces of first and second rotatable cylinders bearing said liquid medium; said liquid transport mechanism comprising a plurality of cooperating pairs of rotatably supported transport rollers, surface portions of said rollers in each said pair contacting each other, a surface portion of one of said rollers of each pair of said transport rollers being in contact with said surface of one of said cylinders, an axis of rotation of each said transport roller intersecting an axis of rotation of each of said cylinders at an angle of less than 90°, and axes of rotation of said rollers in each said pair being parallel to each other one of said transport rollers being in contact with said first rotatable cylinder and the other of said transport rollers being in contact with said second rotatable cylinder.

2. A liquid transport mechanism for distributing a liquid medium evenly on a surface of a rotatable cylinder bearing said liquid medium; said liquid transport mechanism comprising a plurality of cooperating pairs of rotatably supported transport rollers, a plurality of intermediate rollers placed between and in contact with said pairs of rollers, a surface portion of each said transport roller being in contact with said surface of said cylinder, an axis of rotation of each said transport roller intersecting an axis of rotation of said cylinder at an angle of less than 90°, and axes of rotation of said rollers in each said pair intersecting at an angle of 90°.

* * * * *